US005627004A

United States Patent [19]

Grushkin

[11] Patent Number: 5,627,004

[45] Date of Patent: May 6, 1997

[54] PROCESSES FOR PRODUCING NEGATIVELY CHARGED TONER

[75] Inventor: Bernard Grushkin, Pittsford, N.Y.

[73] Assignee: Xerox Corporation, Stamford, Conn.

[21] Appl. No.: 721,688

[22] Filed: Sep. 27, 1996

[51] Int. Cl.[6] ..... G03G 9/087

[52] U.S. Cl. ..... 430/137; 523/334; 523/335; 523/339

[58] Field of Search ..... 430/137; 523/334, 523/335, 339

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,403,693 | 4/1995 | Patel et al. | 430/137 |

*Primary Examiner*—Roland Martin
*Attorney, Agent, or Firm*—E. O. Palazzo

[57] ABSTRACT

A process for the preparation of negatively charged toner comprising:

(i) preparing a pigment dispersion, which dispersion is comprised of a pigment, an ionic surfactant, and optionally a charge control agent;

(ii) shearing said pigment dispersion with a latex or emulsion blend comprised of a resin of styrene-vinylidene chloride-acrylic acid, styrene-vinyl chloride-acrylic acid, styrene-chloroprene-acrylic acid, styrene-butylacrylate-vinylidene chloride-acrylic acid, styrene-butylacrylate-vinyl chloride-acrylic acid, styrene-butadiene-vinylidene chloride-acrylic acid, or styrene-isoprene-vinylidene chloride-acrylic acid, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

25 Claims, No Drawings

PROCESSES FOR PRODUCING NEGATIVELY CHARGED TONER

BACKGROUND OF THE INVENTION

The present invention is generally directed to toner processes, and more specifically, to aggregation and coalescence processes for the preparation of toner compositions. In embodiments, the present invention is directed to the economical preparation of toners without the utilization of the known pulverization and/or classification methods, and wherein in embodiments toner compositions with a volume average diameter of from about 1 to about 25, and preferably from 1 to about 10 microns, and narrow GSD of, for example, from about 1.16 to about 1.26 as measured on the Coulter Counter can be obtained. The resulting toners can be selected for known electrophotographic imaging, printing processes, including color processes, and lithography. In embodiments, the present invention is directed to a process comprised of dispersing a pigment and optionally toner additives like a charge control agent or additive in an aqueous mixture containing an ionic surfactant in an amount of from about 0.5 percent (weight percent throughout unless otherwise indicated) to about 10 percent, and shearing this mixture with a certain latex or emulsion mixture comprised of suspended submicron resin particles of from, for example, about 0.01 micron to about 2 microns in volume average diameter in an aqueous solution containing a counterionic surfactant in amounts of from about 1 percent to about 10 percent with opposite charge to the ionic surfactant of the pigment dispersion, and nonionic surfactant in amounts of from about 0 percent to about 5 percent, thereby causing a flocculation of resin particles, pigment particles and optional charge control agent, followed by heating at about 5° to about 40° C. below the resin Tg and preferably about 5° to about 25° C. below the resin Tg while stirring of the flocculent mixture, which is believed to form statically bound aggregates of from about 1 micron to about 10 microns in volume average diameter comprised of resin, pigment and optionally charge control particles, and thereafter heating the formed bound aggregates about above the Tg (glass transition temperature) of the resin. The size of the aforementioned statistically bonded aggregated particles can be controlled by adjusting the temperature in the below the resin Tg heating stage. An increase in the temperature causes an increase in the size of the aggregated particle. This process of aggregating submicron latex and pigment particles is kinetically controlled, that is, the temperature increases the process of aggregation. The higher the temperature during stirring the quicker the aggregates are formed, for example from about 2 to about 10 times faster in embodiments, and the latex submicron particles are picked up more quickly. The temperature also controls in embodiments the particle size distribution of the aggregates, for example the higher the temperature the narrower the particle size distribution and this narrower distribution can be achieved in, for example, from about 0.5 to about 24 hours and preferably in about 1 to about 3 hours time. Heating the mixture about above or in embodiments equal to the resin Tg generates toner particles with, for example, an volume average particle diameter of from about 1 to about 25 and preferably 10 microns. It is believed that during the heating stage, the components of aggregated particles fuse together to form composite toner particles.

Of importance with respect to the present invention is the selection of a latex mixture comprised of three or more monomers, one of which is vinyl halide, such as vinyl chloride, a vinylidene halide, such as vinylidene chloride, or mixtures thereof. Monomers present in the latex include, for example, four monomers such as styrene, butyl acrylate, acrylic acid and vinylidene chloride. With such monomers, there are enabled toner polymer resin binders that enhance negative charging of the toner. For example, the negative charge on the toner with a polymer resulting from the four monomer mixture of styrene, butyl acrylate, vinylidene chloride and acrylic acid is generally from about 15 μC/gram to about 25 μC/gram before any external additives are included onto the toner; when only styrene, butylacrylate and acrylic acid monomers are used, tribocharging of the resultant toner is from about 10 to about 15 μC/gram.

In embodiments thereof, the present invention is directed to an in situ process comprised of first dispersing a pigment, such as HELIOGEN BLUE™ or HOSTAPERM PINK™, in an aqueous mixture containing a cationic surfactant, such as benzalkonium chloride (SANIZOL B-50™). Utilizing a high shearing device, such as a Brinkmann Polytron, microfluidizer or sonicator, thereafter shearing this mixture with a latex of suspended resin particles, such as poly(styrene butadiene-vinylidene chloride-acrylic acid), and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate, for example NEOGEN R™ or NEOGEN SC™, and a nonionic surfactant, such as alkyl phenoxy poly(ethyleneoxy)ethanol, for example IGEPAL 897™ or ANTAROX 897™, thereby resulting in a flocculation, or heterocoagulation of the resin particles with the pigment particles; and which, on further stirring for about 1 to about 3 hours while heating, for example, from about 35° to about 45° C., results in the formation of statically bound aggregates ranging in size of from about 0.5 micron to about 10 microns in average diameter size as measured by the Coulter Counter (Microsizer II), where the size of those aggregated particles and their distribution can be controlled by the temperature of heating, for example from about 5° to about 25° C. below the resin Tg, and where the speed at which toner size aggregates are formed can also be controlled by the temperature. Thereafter, heating from about 5° to about 50° C. above the resin Tg provides for particle fusion or coalescence of the polymer and pigment particles, followed by optional washing with, for example, hot water to remove surfactant, and drying whereby toner particles comprised of resin and pigment with various particle size diameters can be obtained, such as from 1 to about 20, and preferably 12 microns in volume average particle diameter. The aforementioned toners are especially useful for the development of colored images with excellent line and solid resolution, and wherein substantially no background deposits are present.

There is illustrated in U.S. Pat. No. 4,996,127 a toner of associated particles of secondary particles comprising primary particles of certain polymers having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of an acrylic acid polar group, see Comparative Example I. In U.S. Pat. No. 4,983,488, there is disclosed a process for the preparation of toners by the polymerization of certain polymerizable monomers dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner.

Emulsion/aggregation processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions wherein there is selected a three monomer latex mixture.

In a further object of the present invention there is provided a process for the preparation of toner compositions with an average particle volume diameter of from between about 1 to about 20 microns, and preferably from about 1 to about 7 microns, and with a narrow GSD of from about 1.2 to about 1.3, and preferably from about 1.16 to about 1.25 as measured by a Coulter Counter, and which toners possess an enhanced negative triboelectric charge.

In a further object of the present invention there is provided a process for the preparation of toner compositions with certain effective particle sizes by controlling the temperature of the aggregation, which comprises stirring and heating about below the resin glass transition temperature (Tg), and wherein chlorine containing polymers derived from monomers, such as vinyl chloride and vinylidene chloride, are incorporated into the polymer resin binder of the emulsion/aggregation particles thereby enhancing the negative triboelectric charging thereof. Monomers, such as vinyl chloride, can be added during the emulsion polymerization process, or in embodiments commercially available emulsions can be combined with the latex during the aggregation.

In a further object of the present invention there is provided a process for the preparation of toners with particle size distribution which can be improved from 1.4 to about 1.16 as measured by the Coulter Counter by increasing the temperature of aggregation from about 25° C. to about 45° C.

In a further object of the present invention there is provided a process that is rapid as, for example, the aggregation time can be reduced to below 1 to 3 hours by increasing the temperature from room, about 25° C., temperature (RT) to a temperature below 5° C. to 20° C. Tg, and wherein the process consumes from about 2 to about 8 hours.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

These and other objects of the present invention are accomplished in embodiments by the provision of toners and processes thereof. In embodiments of the present invention, there are provided processes for the economical direct preparation of toner compositions by flocculation or heterocoagulation and coalescence, and wherein the temperature of aggregation can be utilized to control the final toner particle size, that is volume average diameter. More specifically, the present invention relates to a process for the preparation of toner comprising:

(i) preparing a pigment dispersion, which dispersion is comprised of a pigment, an ionic surfactant, and optionally a charge control agent;

(ii) shearing said pigment dispersion with a latex or emulsion blend comprised of a resin of styrene-vinylidene chloride-acrylic acid, styrene-vinyl chloride-acrylic acid, styrene-chloroprene-acrylic acid, styrene-butylacrylate-vinylidene chloride-acrylic acid, styrene-butylacrylate-vinyl chloride-acrylic acid, styrene-butadiene-vinylidene chloride-acrylic acid, or styrene-isoprene-vinylidene chloride-acrylic acid, a counterionic surfactant with a charge polarity of opposite sign to that of said ionic surfactant, and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

In embodiments, the present invention is directed to processes for the preparation of toner compositions, which comprises initially attaining or generating an ionic pigment dispersion, for example dispersing an aqueous mixture of a pigment or pigments, such as carbon black like REGAL 330®, phthalocyanine, quinacridone or RHODAMINE B™ type with a cationic surfactant, such as benzalkonium chloride, by utilizing a high shearing device, such as a Brinkmann Polytron, thereafter shearing this mixture by utilizing a high shearing device, such as a Brinkmann Polytron, a sonicator or microfluidizer with a suspended resin mixture comprised of the monomers illustrated herein, such as styrene-vinylidene chloride-acrylic acid, styrene-chloroprene-acrylic acid; styrene-butylacrylate-vinylidene chloride-acrylic acid, styrene-butadiene-vinylidenechloride-acrylic acid, styrene-butadiene-vinyl chloride-acrylic acid, styrene-vinyl chloride-acrylic acid, styrene-isoprene-vinyl chloride-acrylic acid, styrene-isoprene-chloroprene-acrylic acid, styrene-isoprene-vinylidene chloride-acrylic acid, styrene-vinyl chloride-vinylidene chloride-acrylic acid, and wherein the particle size of the suspended resin mixture is, for example, from about 0.01 to about 0.5 micron in an aqueous surfactant mixture containing an anionic surfactant, such as sodium dodecylbenzene sulfonate, and nonionic surfactant; resulting in a flocculation, or heterocoagulation of the polymer or resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below about the resin Tg, for example from about 5° to about 15° C., and allowing the formation of electrostatically stabilized aggregates ranging from about 0.5 micron to about 10 microns; followed by heating above about the resin Tg, for example from about 5° to about 50° C., to cause coalescence of the latex, pigment particles, and followed by washing with, for example, hot water, wherein hot, for example, refers to a temperature of from about 50° to about 75° C., to remove, for example, surfactant, and drying, such as by use of an Aeromatic fluid bed dryer, freeze dryer, or spray dryer; whereby toner particles comprised of resin pigment, and optional charge control additive with various particle size diameters can be obtained, such as from about 1 to about 10 microns in volume average particle diameter as measured by the Coulter Counter.

One preferred method of obtaining the pigment dispersion depends on the form of the pigment utilized. In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents, such as the aforementioned ionic or nonionic surfactants.

In embodiments, the present invention relates to a process for the preparation of negatively charged toner compositions with controlled particle size comprising:

(i) preparing a pigment dispersion in water, which dispersion is comprised of a pigment, an ionic surfactant, and optionally, a charge control agent;

(ii) shearing the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids, and wherein the resin particles are comprised of a mixture of three monomers, and which particles include styrene-vinylidene chloride-acrylic acid, styrene-vinyl chloride-acrylic acid; styrene-chloroprene-acrylic acid; styrene-isoprene-vinylidene chloride-acrylic acid, and the like;

(iii) heating, for example, from about 35° C. to about 50° C. the sheared blend at temperatures below the about or equal resin Tg, for example from about 5° C. to about 20° C., while continuously stirring to form electrostatically bound relatively stable (for Coulter Counter measurements) toner size aggregates with narrow particle size distribution;

(iv) heating, for example, from about 60° C. to about 95° C., the statically bound aggregated particles at temperatures of about 5° C. to 50° C. above the resin Tg or wherein the resin Tg is in the range of about 50° C., preferably 52° C., to about 65° C. to enable a mechanically stable, morphologically useful form of said toner composition comprised of polymeric resin, pigment, and optionally, a charge control agent;

(v) separating the toner particles from the water by filtration; and (vi) drying the toner particles.

In embodiments, the heating in (iii) is accomplished at a temperature of from about 29° C. to about 59° C.; the resin Tg in (iii) is from about 50° C. to about 80° C.; heating in (iv) is from about 5° C. to about 50° C. above the Tg; and wherein the resin Tg in (iv) is from about 50° C. to about 80° C.

In embodiments, heating below the glass transition temperature (Tg) can include heating at about the glass transition temperature or slightly higher. Heating above the Tg can include heating at about the Tg or slightly below the Tg, in embodiments.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; and the like. As colored pigments, there can be selected cyan, magenta, yellow, red, green, brown, blue or mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilidephenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The pigments selected are present in various effective amounts, such as from about 1 weight percent to about 65 weight and preferably from about 2 to about 12 percent, of the toner.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of monomers used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight, of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregate comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 4 weight percent, reference U.S. Pat. Nos. 3,590,000; 3,720,617; 3,655,374 and 3,983,045, the disclosures of which are totally incorporated herein by reference. Preferred additives include zinc stearate, treated silicas such as AEROSIL R972®, R805® available from Degussa, CAB-O-SIL TS720® from Cabot Corporation, or titania, such as MT3103 from Tayca Corporation, in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

In embodiments, toner particles obtained by the processes illustrated herein treated with 0.6 weight percent of the fumed silica R805® available from DeGussa in a high speed blender, such as a Henschel type blender, and converted to developer by mixing 4 weight percent of the surface additive treated toner with 65 micron steel shot that had been coated with PMMA (polymethylmethacrylate) results in toner having from 35 to 40 μC/gram negative charge. In a like manner, toner treated with 1 to 2 percent of MT3103 titania, available from Degussa Chemicals, achieved a comparable charge.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

Latex Preparation

A polymeric or emulsion latex was prepared by the emulsion polymerization of styrene/butylacrylate/vinylchloride/acrylic acid (64/16/18/2 parts) in nonionic/anionic surfactant solution (3 percent) as follows. Into a 2 liter reactor were added 72 grams of vinyl chloride, 25.6 grams of styrene, 6.4 grams of butyl acrylate, 0.8 gram of acrylic acid, and 2.2 grams of dodecanethiol in 600 milliliters of deionized water with 9 grams of sodium dodecyl benzene sulfonate, 8.6 grams of polyoxyethylene nonyl phenyl ether, and 4 grams of ammonium persulfate. The mixture was then brought up to 70° C. whereupon a solution consisting of 225 grams of styrene, 57.6 grams of butyl acrylate, 7,2 grams of acrylic acid, and 7.8 grams of dodecanethiol was added over the next four hours. The mixture was kept at 70° C. for an additional 4 hours then cooled to room temperature. A sample of the resultant latex composition, after drying, had a Tg of 58° C. The particle size of the latex as measured on a Brookhaven BI-90 Particle Nanosizer was 150 nanometers.

Pigment Dispersion and Aggregation

14 Grams of dry pigment PV FAST BLUE™ and 2.92 grams of cationic surfactant SANIZOL B-50™ were dispersed in 400 grams of water using an ultrasonic probe. The dispersion of the PV FAST BLUE™ was placed in the SD41 continuous blender. The aforementioned pigment dispersion was sheared for 3 minutes at 10,000 rpm. 650 Grams of the above latex were added while shearing. Shearing was continued for an extra 8 minutes at 10,000 rpm. 400 Grams of this blend were than transferred into a kettle placed in the heating mantle and equipped with mechanical stirrer and temperature probe. The temperature of the mixture was raised from 25° C. (room temperature) to 45° C., step (iii), and this aggregation was performed for 24 hours.

Coalescence

40 Milliliters of a 20 percent solution of anionic surfactant (NEOGEN R™) were added while stirring prior to raising the temperature of the aggregated particles in the kettle to 80° C. The heating was continued at 80° C. for 3 hours to coalesce the aggregated particles. No change in the particle size and the GSD was observed, compared to the size of the aggregates. Particles were filtered, washed using hot deionized water, and dried on the freeze dryer. The resulting cyan toner was comprised of 95 percent resin of poly(styrene-co-butylacrylate-co-vinyl chloride-co-acrylic acid), and 5 percent of PV FAST BLUE™ pigment. Toner aggregates particle size as measured on the Coulter Counter after 1 hour and 24 hours was 4.7 microns volume average diameter, and the GSD was 1.25.

Coalesced particles were thoroughly washed with deionized water to remove surfactant, then dried in a circulating warm air oven. A developer was then prepared by mixing 4 grams of the dried toner with 100 grams of carrier. The carrier was 65 micron iron core coated with 1 percent of polymethyl methacrylate. The developer was agitated on a roll mill for thirty minutes, after which the triboelectric charge of the toner was measured by removing the toner from the carrier in a Faraday Cage. The charge thus measured was 25 μC/gram.

COMPARATIVE EXAMPLE 1

(Styrene/Butylacrylate/Acrylic Acid)

A latex was prepared by the emulsion polymerization of styrene/butylacrylate/acrylic acid (82/18/2 parts) in nonionic/anionic surfactant solution (3 percent) as follows. 352 Grams of styrene, 48 grams of butyl acrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether-nonionic surfactant (ANTAROX 897™—70 percent active), and 4 grams of ammonium persulfate initiator were dissolved. The emulsion was then polymerized at 70° C. for 8 hours. The resulting latex, 60 percent of water and 40 percent (weight percent throughout) of solids, was comprised of a copolymer of polystyrene/polybutyl acrylate/polyacrylic acid, 82/18/2; the Tg of the latex dry sample was 53.1° C., as measured on a DuPont DSC; $M_w$: 26,600, and $M_n$=1,200 as determined on a Hewlett Packard GPC.

Pigment Dispersion

14 Grams of dry pigment PV FAST BLUE™ and 2.92 grams of cationic surfactant SANIZOL B-50™ were dispersed in 400 grams of water using an ultrasonic probe.

Preparation of the Aggregated Particles

The above dispersion of the PV FAST BLUE™ was placed in the SD41 continuous blender. 2.92 Grams of SANIZOL B-50™ in 400 milliliters of deionized water were also added. The aforementioned pigment dispersion was sheared for 3 minutes at 10,000 rpm. 650 Grams of the above latex were added while shearing. Shearing was continued for an extra 8 minutes at 10,000 rpm. 400 Grams of this blend were than transferred into a kettle placed in the heating mantle and equipped with mechanical stirrer and temperature probe. The temperature of the mixture was raised from 25° C. (room temperature) to 45° C., step (iii), and this aggregation was performed for 24 hours.

Coalescence of Aggregated Particles

40 Milliliters of a 20 percent solution of anionic surfactant (NEOGEN R™) were added while stirring prior to raising the temperature of the aggregated particles in the kettle to 80° C. The heating was continued at 80° C. for 3 hours to coalesce the aggregated particles. No change in the particle size and the GSD was observed, compared to the size of the aggregates. Particles were filtered, washed using hot deionized water, and dried on the freeze dryer. The resulting cyan toner was comprised of 95 percent resin of poly(styrene-co-butylacrylate-co-acrylic acid), and 5 percent of PV FAST BLUE™ pigment. Toner aggregate particle size as measured on the Coulter Counter after 1 hour and 24 hours was 4.2 microns volume average diameter, and the GSD was 1.25.

After washing and drying, 4 grams of the toner particles were agitated for thirty minutes on a roll mill with 100 grams of 65 micron iron carrier that had been coated with 1 percent polymethyl methacrylate. The resultant toner charge, as measured in a tribo blow off apparatus, was 10 μC/gram.

EXAMPLE II (Styrene/Butadiene/Vinylidene Chloride Acrylic Acid)

Emulsion Polymerization

A polymeric latex was prepared by emulsion polymerization of styrene/butadiene/vinylidene chloride/acrylic acid (70/10/18/2 parts) in a nonionic/anionic surfactant solution (NEOGEN R™/IGEPAL CA 897™, 3 percent). The same procedure as used in Example I was followed to prepare the latex. The resulting latex contained 60 percent of water and 40 percent of solids. Into a 2 liter reactor were added 72 grams of vinylidene chloride, 28 grams of styrene, 4 grams of butadiene, 0.8 gram of acrylic acid and 2.2 grams of dodecanethiol in 600 milliliters of deionized water with 9 grams of sodium dodecyl benzene sulfonate, 8.6 grams of polyoxyethylene nonyl phenyl ether, and 4 grams of ammonium persulfate. The mixture was then brought up to 70° C. whereupon a solution consisting of 252 grams of styrene, 36 grams of butadiene, 7.2 grams of acrylic acid and 7.8 grams of dodecanethiol was added over the next four hours. The mixture was kept at 70° C. for an additional 4 hours then cooled to room temperature. A sample of the resultant latex composition, after drying, had a Tg of 56° C. The particle size of the latex as measured on Brookhaven BI-90 Particle Nanosizer was 160 nanometers.

Pigment Dispersion

280 Grams of dry pigment PV FAST BLUE™ and 58.5 grams of cationic surfactant SANIZOL B-50™ were dispersed in 8,000 grams of water using a microfluidizer.

Preparation of the Aggregated Particles

417 Grams of the above PV FAST BLUE™ dispersion, which contained 14 grams of PV FAST BLUE™ pigment, were added to the above prepared latex in the SD41 continuous stirring device containing 600 milliliters of water with 2.9 grams of cationic surfactant SANIZOL B-50™. The pigment dispersion and the latex were well mixed by continuous pumping through the rotor stator operating at 10,000 rpm for 8 minutes. This blend was then transferred into a kettle that was placed in a heating mantle and equipped with mechanical stirrer and temperature probe. The aggregation was performed at 45° C. for 4 hours. Aggregates with a particle size of about 4.5 were obtained. After aggregation, 35 milliliters of 10 percent anionic surfactant (NEOGEN R™) were added, and the temperature was increased from 45° C. to about 80° C. Particle size of the coalesced particles, as determined by Coulter Counter analysis, was 4.6 μm.

After washing and drying, 4 grams of the toner particles were agitated for thirty minutes on a roll mill with 100 grams of 65 micron iron carrier that had been coated with 1 percent polymethyl methacrylate. The resultant toner charge, as measured in a tribo blow off apparatus was 32 μC/gram.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A process for the preparation of negatively charged toner comprising:

(i) preparing a pigment dispersion, which dispersion is comprised of a pigment, an ionic surfactant, and optionally a charge control agent;

(ii) shearing said pigment dispersion with a latex or emulsion blend comprised selected from the group consisting of a resin of styrene-vinylidene chloride-acrylic acid, styrene-vinyl chloride-acrylic acid, styrene-chloroprene-acrylic acid, styrene-butylacrylate-vinylidene chloride-acrylic acid, styrene-butylacrylate-vinyl chloride-acrylic acid, styrene-butadiene-vinylidene chloride-acrylic acid, or styrene-isoprene-vinylidene chloride-acrylic acid, a counterionic surfactant with a charge polarity of opposite sign to that of said ionic surfactant and a nonionic surfactant to produce a sheared blend;

(iii) heating the above sheared blend below about the glass transition temperature (Tg) of the resin to form electrostatically bound toner size aggregates with a narrow particle size distribution; and (iv) heating said bound aggregates above about the Tg of the resin.

2. A process in accordance with claim 1 wherein the particle size distribution of the aggregated particles is narrower, about 1.40 decreasing to about 1.16, when the temperature is increased from room temperature to 50° C., and wherein said temperature is below the resin Tg.

3. A process in accordance with claim 1 wherein the number of fines of unaggregated submicron particles present is smaller, from more than about 20 percent to less than about 2 percent, when the temperature is increased from room temperature to 50° C., and wherein said temperature is below the resin Tg.

4. A process in accordance with claim 1 wherein the temperature of the aggregation (iii) controls the speed at which particles submicron in size are collected to form toner size aggregates.

5. A process in accordance with claim 1 wherein the surfactant utilized in preparing the pigment dispersion is a cationic surfactant, and the counterionic surfactant present in the latex mixture is an anionic surfactant.

6. A process in accordance with claim 1 wherein the surfactant utilized in preparing the pigment dispersion is an anionic surfactant, and the counterionic surfactant present in the latex mixture is a cationic surfactant.

7. A process in accordance with claim 1 wherein the dispersion of (i) is accomplished by homogenizing at from about 1,000 revolutions per minute to about 10,000 revolutions per minute, at a temperature of from about 25° C. to about 35° C., and for a duration of from about 1 minute to about 120 minutes.

8. A process in accordance with claim 1 wherein the dispersion of (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

9. A process in accordance with claim 1 wherein the shearing or homogenization (ii) is accomplished by homogenizing at from about 1,000 revolutions per minute to about 10,000 revolutions per minute for a duration of from about 1 minute to about 120 minutes.

10. A process in accordance with claim 1 wherein the heating of the blend of latex, pigment, surfactants and optional charge control agent in (iii) is accomplished at temperatures of from about 20° C. to about 5° C. below the Tg of the resin for a duration of from about 0.5 hour to about 6 hours.

11. A process in accordance with claim 1 wherein the heating of the electrostatically bound aggregate particles to form toner size composite particles comprised of pigment, said resin and optional charge control agent is accomplished at a temperature of from about 10° C. above the Tg of the resin to about 95° C. for a duration of from about 1 hour to about 8 hours.

12. A process in accordance with claim 1 wherein the toner resulting possesses an enhanced negative triboelectric charge.

13. A process in accordance with claim 1 wherein the toner resulting possesses an enhanced negative triboelectric charge of from about 20 to about 50 microcoulombs per gram.

14. A process in accordance with claim 1 wherein the toner resulting possesses an enhanced stable negative triboelectric charge of from about 20 to about 35 microcoulombs per gram.

15. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

16. A process in accordance with claim 1 wherein the anionic surfactant is selected from the group consisting of sodium dodecyl sulfate, sodium dodecylbenzene sulfate and sodium dodecylnaphthalene sulfate.

17. A process in accordance with claim 1 wherein the pigment is carbon black, magnetite, cyan, yellow, or magenta, and mixtures thereof.

18. A process in accordance with claim 1 wherein the toner particles isolated are from about 3 to about 15 microns in volume average diameter, and the geometric size distribution thereof is from about 1.18 to about 1.40.

19. A process in accordance with claim 1 wherein the nonionic surfactant concentration is from about 0.1 to about 5 weight percent; the anionic surfactant concentration is about 0.1 to about 5 weight percent; and the cationic surfactant concentration is about 0.1 to about 5 weight percent of the toner components of resin, pigment and charge agent.

20. A process in accordance with claim 1 wherein there is added to the surface of the formed toner metal salts, metal salts of fatty acids, silicas, metal oxides, or mixtures thereof, in an amount of from about 0.1 to about 10 weight percent of the obtained toner particles.

21. A process in accordance with claim 1 wherein the toner is washed with warm water, and the surfactants are removed from the toner surface, followed by drying.

22. A process in accordance with claim 1 wherein heating in (iii) is from about 5° C. to about 25° C. below the Tg.

23. A process in accordance with claim 1 wherein heating in (iii) is accomplished at a temperature of from about 29° to about 59° C.

24. A process in accordance with claim 1 wherein the resin Tg in (iii) is from about 50° to about 80° C.

25. A process in accordance with claim 1 wherein heating in (iv) is from about 5° to about 50° C. above the Tg, and wherein the resin Tg in (iv) is from about 50° to about 80° C.

* * * * *